US010196803B2

(12) United States Patent
Muehlhausen et al.

(10) Patent No.: US 10,196,803 B2
(45) **Date of Patent: *Feb. 5, 2019**

(54) TOILET BALLS WITH FLUSHING WATER DISTRIBUTOR

(71) Applicant: Henkel AG & Co. KGaA, Duesseldorf (DE)

(72) Inventors: Hans-Georg Muehlhausen, Duesseldorf (DE); Ralph Butter-Jentsch, Langenfeld (DE)

(73) Assignee: Henkel AG & Co. KGaA (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/373,658

(22) Filed: Dec. 9, 2016

(65) Prior Publication Data

US 2017/0226723 A1 Aug. 10, 2017

Related U.S. Application Data

(60) Continuation of application No. 13/457,643, filed on Apr. 27, 2012, now Pat. No. 9,546,477, which is a division of application No. 12/987,297, filed on Jan. 10, 2011, now Pat. No. 8,181,282, which is a continuation of application No. PCT/EP2009/052955, filed on Mar. 13, 2009.

(30) Foreign Application Priority Data

Aug. 14, 2008 (DE) ..... 10 2008 037 723

(51) Int. Cl.
*E03D 9/02* (2006.01)

(52) U.S. Cl.
CPC ..... *E03D 9/022* (2013.01); *E03D 2009/024* (2013.01); *E03D 2009/026* (2013.01)

(58) Field of Classification Search
CPC ..... E03D 9/022; E03D 2009/024; E03D 2009/026
USPC ..... 4/231
See application file for complete search history.

(56) References Cited

U.S. PATENT DOCUMENTS

| | | | |
|---|---|---|---|
| 1,067,472 | A | 7/1913 | Creed |
| 1,091,265 | A | 3/1914 | Wohlander |
| 3,588,926 | A | 6/1971 | Buck |

(Continued)

FOREIGN PATENT DOCUMENTS

| | | | |
|---|---|---|---|
| DE | 8001994 | U1 | 5/1980 |
| DE | 3424317 | A1 | 1/1986 |

(Continued)

*Primary Examiner* — Huyen Le
(74) *Attorney, Agent, or Firm* — Bojuan Deng

(57) ABSTRACT

Toilet basket (1) for receiving solid or gelled preparations having at least one container (3*a*, 3*b*, 3*c*, 3*d*) for receiving at least one preparation (4*a*, 4*b*, 4*c*, 4*d*), the container (3*a*, 3*b*, 3*c*, 3*d*) positionable below the toilet rim so that flushing water can flow over it when the toilet is flushed, and at least one inlet opening (5*a*, 5*b*, 5*c*, 5*d*) and one outlet opening (6*a*, 6*b*, 6*c*, 6*d*) shaped in the container wall (7) for the flushing water; a holder (2) for mounting the toilet basket (1) on the bowl rim; a flushing water distributing element (8) arranged and configured on the toilet basket (1) so that the flushing water distributing element (8) is impinged upon by flushing water upon flushing, and an equalized delivery of flushing water into the inlet opening (5*a*, 5*b*, 5*c*, 5*d*) of the container (3*a*, 3*b*, 3*c*, 3*d*) is produced.

11 Claims, 6 Drawing Sheets

(56) References Cited

U.S. PATENT DOCUMENTS

| | | | |
|---|---|---|---|
| 4,143,431 | A | 3/1979 | Goncalves |
| 4,168,551 | A | 9/1979 | Hautmann et al. |
| D257,738 | S | 12/1980 | Manthei |
| 4,615,054 | A | 10/1986 | Beucheler et al. |
| D308,408 | S | 6/1990 | Hoyt et al. |
| 6,230,334 | B1 | 5/2001 | Camp et al. |
| 6,389,610 | B1 | 5/2002 | Hautmann et al. |
| 6,651,261 | B1 | 11/2003 | Leonard et al. |
| D507,628 | S | 7/2005 | McLellan et al. |
| 6,928,668 | B2 | 8/2005 | Kuhn |
| 6,934,973 | B2 | 8/2005 | Lehmann et al. |
| 6,976,277 | B2 | 12/2005 | Keramidas |
| 7,114,199 | B2 | 10/2006 | Conway et al. |
| 8,291,523 | B2 | 10/2012 | Virica |
| 9,366,016 | B2 * | 6/2016 | Butter-Jentsch ..... E03D 9/032 |
| 2004/0068782 | A1 | 4/2004 | Butter-Jentsch et al. |
| 2007/0245470 | A1 | 10/2007 | Nguyen et al. |
| 2010/0192291 | A1 | 8/2010 | Burt et al. |

FOREIGN PATENT DOCUMENTS

| | | | |
|---|---|---|---|
| DE | 19520145 | A1 | 12/1996 |
| EP | 1449969 | A2 | 8/2004 |
| EP | 1936049 | A2 | 6/2008 |
| WO | 2007/104977 | A2 | 9/2007 |
| WO | 2008/080642 | A1 | 7/2008 |

* cited by examiner

TOILET BALLS WITH FLUSHING WATER DISTRIBUTOR

CROSS REFERENCE TO RELATED APPLICATIONS

The present application is continuation of U.S. patent application Ser. No. 13/457,643 which was filed Apr. 27, 2012, which is a divisional application of U.S. patent application Ser. No. 12/987,297 filed 10 Jan. 2011, which is a continuation of International Patent Application No. PCT/EP2009/052955 filed Mar. 13, 2009, which claims priority to German Patent Application No. 10 2008 037 723.6 filed Aug. 14, 2008, each of which are incorporated herein by reference.

The present invention relates to a toilet basket having a flushing water distributing element.

For automatic cleaning of toilet bowls, it is known to attach active-substance preparations in lump form in a cage-like container to the inner rim of the toilet bowl. With each flushing operation, a portion of the active substance becomes dissolved in the flushing water and is distributed with the water into the bowl.

Active-substance preparations used in such applications can be shaped into dimensionally stable, non-deliquescent blocks that still possess sufficient solubility so that a sufficient quantity of active substances is delivered into the water during the short flushing phase. It is also important that the active-substance block remain unmodified after the flushing operation, aside from a scent delivery.

An example of one such active-substance preparation is described in German Patent Application Publication No. 34 24 317 A1. The preparation contains anionic and nonionic surfactants, perfume, cellulose powder, rinse-out regulators, inorganic salts, complexing agents, lime-dissolving acids, antimicrobial active substances, plasticizers, and further usual additives.

Single-use toilet baskets which must be disposed of after the active-substance block is completely dissolved are known. More environmentally favorable are the (likewise known) refillable toilet baskets, two of which are described in DE 80 01 994 U1 and DE 34 23 758 A1.

Those toilet baskets known for receiving lump-type toilet cleaning blocks are typically not usable for pastes or liquids. This is because the paste or liquid is not intended to flow or drip spontaneously out of the basket after completion of the flushing operation. In addition, only a defined fraction of the liquid or paste is to be delivered at each flushing operation. This fraction of active-substance preparation delivered should be as identical as possible at each flushing operation. Toilet baskets of this kind for pasty or liquid preparations are known, for example, from DE 19520145A1 or from EP 133423961.

Also known in the art are multi-chamber receptacles for active-substance preparations described above, which are suspended in the toilet bowl in such a way that in the context of the flushing operation of the toilet bowl with water, an active-substance delivery from the toilet basket into the toilet bowl occurs. As a result of the inhomogeneous flow conditions within the flow of flushing water, inhomogeneous emptying of the chambers can occur depending on the positioning of the toilet basket at the edge of the toilet bowl.

A substantial disadvantage of all these toilet baskets is that metering depends substantially on the particular local flow conditions in the toilet bowl during the flushing operation. These flow conditions can be very different depending on the type of toilet and positioning of the toilet basket in or on the toilet bowl. It may happen, for example, that with some types of toilet, no active-substance release from the toilet basket takes place, since no water, or insufficient water, flows over the toilet basket during the flushing operation, resulting in the metering mechanism of the toilet basket not being triggered.

Release of active substances from toilet dispensers of this kind is usually accomplished by penetration of flushing water through openings in the toilet dispenser, wherein the active substances are surface-dissolved and, upon exit of the flushing water through corresponding exit openings, are discharged from the toilet dispenser and carried along. Depending on the arrangement of the toilet dispenser in the toilet, the intensity of flow through it differs because of the often locally very different flow conditions of the flushing water outlet at the rim of the toilet bowl, resulting in only a diffuse delivery of active substances being implemented. This inhomogeneous active-substance delivery represents a substantial disadvantage.

This is particularly problematic if the toilet basket is embodied in an elongated, "linear" fashion, since the aforementioned flow conditions can result in a locally inhomogeneous rinsing of the active substances out of such toilet baskets, such as those described in U.S. Patent Application Publication No. 2007/0245470 A1.

The same also applies to toilet baskets for delivering liquid or gelled active-substance preparations, in which, depending on the configuration of the toilet basket, a distributing element can be provided by means of which, in particular, the liquid active-substance preparations can be delivered by the fact that the active-substance preparation(s) are firstly distributed onto the distributing element in order then to be flowed over by flushing water and delivered into the flushing water. Here as well, the degree of rinsing out is critically dependent on position and on the flow conditions in the toilet.

The present invention therefore attempts to make available a toilet basket that ensures the most homogeneous possible delivery of preparation into the flushing water.

This is achieved by a toilet basket for solid and gelled preparations having at least one container for receiving at least one preparation, wherein the container is positionable below the toilet rim so that flushing water can flow over it when the toilet is flushed, and having at least one inlet opening and one outlet opening in the container wall for the flushing water, a holder for mounting the toilet basket on the bowl rim, and a flushing water distributing element arranged and configured on the toilet basket so that the flushing water distributing element is impinged upon by flushing water upon flushing and an equalized delivery of flushing water into the inlet opening of the container is produced. This is further achieved by a toilet basket for liquid preparations comprising at least one container for receiving at least one preparation and having at least one outlet opening, a preparation distributing element in the shape of a plate having an impingement region over which flushing liquid flows in the context of the flushing operation, wherein the interior of the container is continuously in communication with the preparation distributing element via the outlet opening, with interposition of an arrangement that prevents free flow of the active-substance fluid, a holder for mounting the toilet basket onto the bowl rim, and a flushing water distributing element arranged and configured on the toilet basket so that the flushing water distributing element is impinged upon by flushing water upon flushing and an equalized delivery of flushing water onto the preparation distributing element is produced.

In a first embodiment of the invention, the toilet basket for receiving solid or gelled preparations comprises at least one container for receiving at least one preparation. The container is positionable below the toilet rim in such a way that flushing water can flow over it when the toilet is flushed. The container has at least one inlet opening and one outlet opening shaped in the container wall for the flushing water, and a holder for mounting the toilet basket on the bowl rim. A flushing water distributing element is arranged and configured on the toilet basket so that the flushing water distributing element is impinged upon by flushing water upon flushing, resulting in an equalized delivery of flushing water into the inlet opening of the container being produced.

In another embodiment, the toilet basket is designed for receiving liquid preparations and comprises at least one container for receiving at least one preparation, the container having at least one outlet opening, and a plate-like preparation distributing element having an impingement region over which flushing liquid flows during the flushing operation. The interior of the container is preferably continuously in communication with the preparation distributing element via the outlet opening, with interposition of an arrangement that prevents free flow of the active-substance fluid. The toilet basket further includes a holder for mounting the toilet basket on the bowl rim, as well as a flushing water distributing element arranged and configured on the toilet basket so that the flushing water distributing element is impinged upon by flushing water upon flushing, resulting in an equalized delivery of flushing water onto the preparation distributing element being produced.

An "equalized delivery" is understood for purposes of this Application as a delivery more homogeneous as compared to a toilet basket not having a flushing water distributing element, with flushing water entering into the inlet openings of the container by way of an equalized distribution of flushing water and/or more homogeneous flow distribution along the toilet basket.

In a preferred embodiment, the toilet basket is elastically embodied so that in the installed state it follows the contour of the toilet bowl. In order to achieve this, the toilet basket can be formed from an elastic material or can comprise spring points on which the toilet basket is movably mounted. In particular, the toilet basket can also be made of substantially dimensionally stable containers connected to one another via an elastic connection.

Container—

A "container" is understood to refer to a packaging means suitable for at least partly encasing and/or holding together a solid, liquid, or gelled preparation.

The toilet basket according to the present invention can have one or a plurality of containers. In the embodiment comprising a plurality of containers, they can be arranged next to one another, preferably in a line.

It is further preferred that more than one container be provided on the toilet basket, each receiving either a common preparation or two or more preparations differing from one another. In this manner, preparations that are not shelf-stable with one another can be spatially separated from one another. It is, however, also conceivable in principle, especially in the case of solid preparations, to position preparations differing from one another next to one another in a single container.

In this connection, it is advantageous to design the containers so that an exchange of flushing water between the containers is prevented.

A plurality of containers can be connected integrally to one another. This has the particular advantage that the containers can be integrally shaped, for example, using an injection molding method, and rendering subsequent fitting together of individual containers as superfluous. With this configuration of the containers, it is moreover advantageous to design the containers as half-shells connected to one another by a material bridge. The material bridge serves as a hinge about which the half-shells can be tilted and joined to yield one or more containers.

In another embodiment of the invention, the containers can be connected to one another via a non-water-conveying strut. It is possible in this fashion to design, in particular, dimensionally stable containers that make available sufficient mechanical protection for preparations stocked in them, wherein an elastic connection between the containers can be made by way of the struts so that when utilized, the toilet basket follows the contour of the toilet bowl.

For solid and gelled preparations, the container is designed so that flushing water can flow through it (i.e., it has at least one inlet opening for entry of flushing water and at least one outlet opening for exit of flushing water from the container charged with preparation).

In an advantageous embodiment, when the toilet basket is installed in the toilet, the inlet opening of the container(s) is located outside the flushing water stream. In other words, without use of a flushing water distributing element, no flushing water (or at least only a very small quantity) enters the container(s) through the inlet opening(s).

It is particularly preferred to shape the containers in a substantially ball-like fashion. A ball-like configuration has proven particularly advantageous for homogeneous impingement of flushing water on the containers. This appears to be due in particular to the fact that the ball-like surfaces of the containers reflect and direct the impacting flushing water particularly advantageously. It has been discovered that ball-like surfaces offer a comparatively low flow resistance so that when regions of a toilet basket embodied in this fashion is being impinged upon by a particularly large quantity of flushing water, it is diverted over the ball-like surface to adjacent ball-like containers. In addition, especially between adjacent containers of ball-like configuration, the flushing water is broken up and diverted in such a way that the incident flushing water is homogeneously distributed between the containers. This is discussed in more detail below.

It is also advantageous to design the inlet opening(s) in slit-shaped fashion parallel to the longitudinal axis of the toilet basket.

For liquid preparations in particular, a container preferably has only one outlet opening.

Flushing Water Distributing Element—

The flushing water distributing element aids in equalizing the flushing water stream emerging from the toilet (i.e., it directs the flushing water stream from the exit below the rim of a toilet bowl over the length of the toilet basket as homogeneously as possible into the inlet openings), in order to ensure the most uniform possible dissolution or rinsing of preparation(s) out of the toilet basket over its entire length.

Accordingly, the flushing water distributing element is configured so that when the toilet basket is hung in place, the element is impinged upon by flushing water upon flushing and an equalized delivery of flushing water into the inlet opening of the container or containers is produced.

In an advantageous embodiment, the flushing water distributing element is configured as a baffle plate that generates spray water upon the incidence of flushing water, resulting in equalized wetting or exposure of the containers or inlet openings.

In an embodiment of the toilet basket designed to receive solid or gelled preparations, the flushing water distributing element is arranged below the inlet opening(s) of the container or containers. The flushing water distributing element and the inlet openings are designed so that the surge of flushing water out of the toilet bowl from beneath the toilet rim is directed via the flushing water distributing element to the inlet openings of the containers of the toilet basket.

In a preferred embodiment in which the inlet openings are arranged in the containers above the flushing water distributing element, there is an edge between the inlet openings and the flushing water distributing element that limits direct inflow of flushing water from the flushing water distributing element into a container. The amount of flushing water directed into the containers can be adjusted by way of the spacing between the inlet openings and flushing water distributing element (i.e., the height of the edge). Flushing water that is directed via the flushing water distributing element to the inlet openings is broken up and reflected at the edge, acting similar to a weir. This also contributes to an equalized delivery of flushing water into the inlet openings.

In an alternative embodiment of the toilet basket designed to receive solid or gelled preparation, the flushing water distributing element is arranged above the inlet opening(s) of the container or containers. The flushing water distributing element and the inlet openings are arranged so that the surge of flushing water out of the toilet bowl from beneath the toilet rim is directed via the flushing water distributing element to the inlet openings of the containers of the toilet basket.

The flushing water distributing element is advantageously embodied in the manner of a plate, chute, ramp, or trough.

For better distribution or direction of flushing water over the length of the distributing element, the flushing water distributing element can have flutes extending in a longitudinal direction of the toilet bowl dispenser.

It can also be advantageous to configure the flushing water distributing element at least partly as a grid, in particular if the flushing water distributing element is arranged above the inlet openings of the container or containers. This produces a homogeneous dripping into the inlet openings or onto a preparation distributing element.

The flushing water distributing element can be provided in shared fashion for all containers, or separately for the containers. It is particularly advantageous to configure the flushing water distributing element integrally with the container or containers, thereby avoiding an additional production step of fitting.

According to a further preferred embodiment of the invention, the length of the distributing element corresponds substantially to the length of the toilet basket.

Preparation—

Solid preparations, also usually referred to as "toilet blocks", are predominantly manufactured as pressed shaped elements, as extrudates, or by casting methods. It is also conceivable for such shaped elements to have at least partly a gelled or liquid phase. For example, the core of a toilet block can be made of a gel that is secured, for example, by adhesive bonding, in a cavity of the toilet block.

Toilet blocks today usually have a cylindrical or bar-like shape. It is, however, conceivable and desirable to make available shapes that differ from these traditional shapes, so that a more independent identity among consumers can be achieved for a corresponding product. For example, the solid preparations can be designed in ball-like fashion. The diameter of a preferred ball-shaped toilet block is from 1 mm to 10 cm, preferably 5 mm to 5 cm, particularly preferably 1 cm to 3 cm.

Preparations for a toilet basket according to the present invention usually contain substances such as cleaning substances, enzymes, perfume oils, dyes, surfactants or foaming agents. These can involve, for example, natural perfume oils, dyes, and surfactants. The preparation preferably has a surfactant content from 2 to 50 wt % and/or perfume oil content from 1 to 20 wt % and/or dye content from 0.5 to 20 wt %. In a particularly preferred embodiment, the preparation contains at least one enzyme at a concentration from 0.1 to 10 wt %.

It is particularly preferred that a toilet block have at least one first water-soluble basic element as well as at least one external water-soluble layer that at least partly covers the basic element. It is very particularly preferred if the outer layer has visual properties that differ from the basic element, such as color and/or gloss. It is thereby possible to make available to the user an indicator function that indicates, after a few flushing operations, how homogeneously water is flowing over and impinging upon the respective toilet blocks in the toilet basket, informing a user to position the toilet dispenser differently in the toilet bowl if needed.

The outer layer of the toilet block preferably has a thickness of from 10 to 1000 μm, particularly preferably 20 to 500 μm, very particularly preferably 50 to 150 μm. The layer preferably entirely surrounds the basic element.

Preferred toilet blocks have a basic element in the form of a granulate and/or an extrudate and/or a pellet and/or a prill and/or a melt-cast shaped element and/or a tablet.

Holder—

The toilet basket according to the present invention has a holder for attaching the toilet basket to the rim of a toilet bowl.

Such holders usually are rod-shaped elements having two loops, so that due to the spring action of the loops, the holder for the toilet basket can be clamped onto the rim of the toilet.

In an advantageous refinement of the invention, the holder has at least one spring element that, when the toilet dispenser is installed in the toilet, it has a substantially vertical or horizontal spring travel. It is further preferred that the holder have at least two spring elements, so that when the toilet bowl dispenser is installed in the toilet, one spring element has a substantially vertical spring travel and one spring element has a substantially horizontal spring travel. The spring travel that is made available enables improved and more flexible securing of the toilet basket on toilets having different rim edge thicknesses and configurations. In particular, the spring element can be of rhombic configuration.

Further exemplifying embodiments of the invention are explained with reference to the appended drawings, in which.

Figure 9:
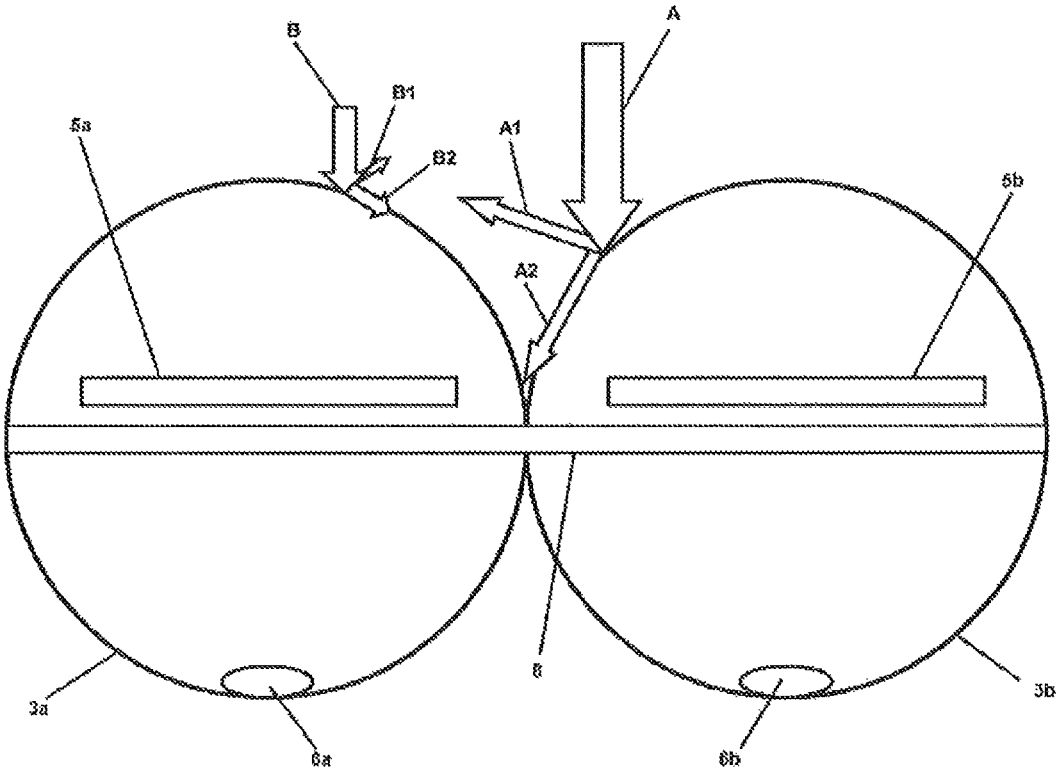
Figure 10A:
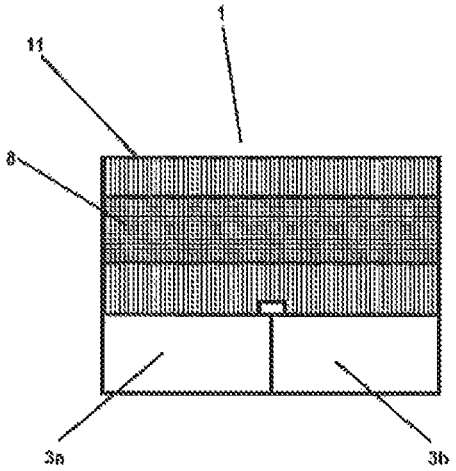
Figure 10B:
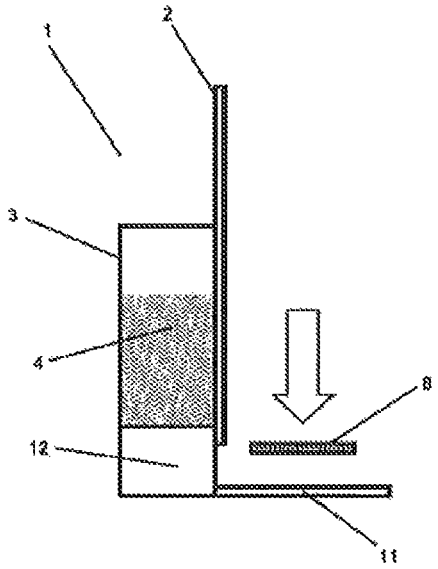
Figure 11:
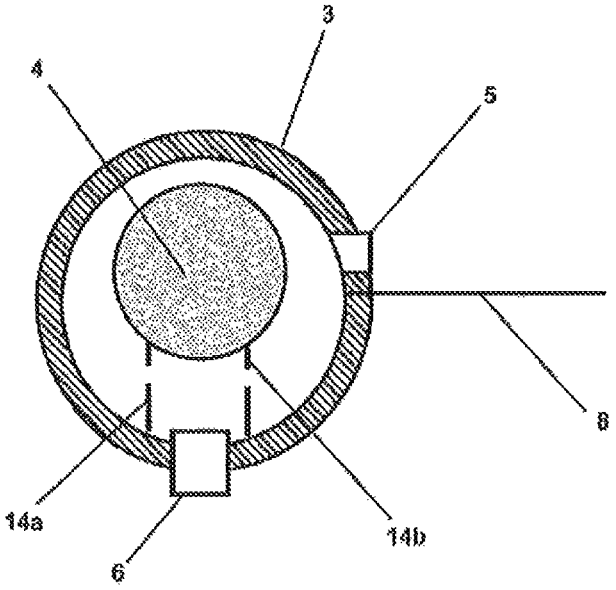

FIG. 9 schematically depicts a toilet basket for solid or gelled preparations, impinged upon by flushing water, having ball-like containers;

FIG. 10(*a*) is a top view and FIG. 10(*b*) is a side view of a toilet basket for liquid preparations, having a preparation distributing element and a flushing water distributing element; and FIG. 11 is a cross section view of a toilet basket having spacing elements.

LIST OF REFERENCE CHARACTERS

Figure 1:
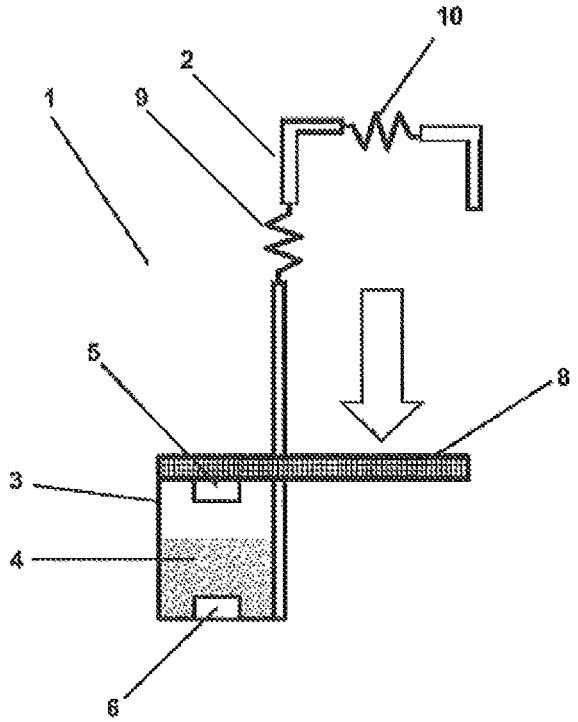
FIG. 1 is a side view of a toilet basket for solid or gelled preparations having a flushing water distributing element arranged above the inlet opening.

1. Toilet basket
2. Holder
3. Container
4. Preparation
5. Inlet opening
6. Outlet opening
7. Container wall
8. Flushing water distributing element
9. Spring element
10. Spring element
11. Distributing element
12. Receptacle
13. Connection
14. Spacing element A first embodiment of the invention is illustrated in FIG. 1, which is a side view or schematic of a toilet basket 1 for solid or gelled preparations 4. The basket 1 has a flushing water distributing element 8 arranged above inlet opening 5. Toilet basket 1 is made up of a container 3 having at its top end an inlet opening 5 through which flushing water can enter the container 3 via flushing water distributing element 8. The flushing water that has entered container 3 dissolves some of the preparation 4 stored in container 3, and the flushing water charged with preparation 4 leaves container 3 through outlet opening 6 and is thus delivered into the interior of the toilet bowl.

In the embodiment shown in FIG. 1, flushing water distributing element 8 is shaped in the manner of a plate. Flushing water distributing element 8 engages into the flushing water stream of the toilet bowl, the main flow direction of the flushing water stream usually being directed downwardly as indicated by the arrow in the direction of gravity. The flushing water stream is broken up by flushing water distributing element 8, which acts similarly to a baffle plate, and is distributed over the surface of flushing water distributing element 8. The surface of flushing water distributing element 8 facing toward the flow of flushing water can include liquid-directing or distributing structures such as capillaries, grids, or flutes extending transversely or longitudinally.

Flushing water distributing element 8 can also include an opening through which flushing water can flow into inlet opening 5 of container 3.

As may further be gathered from FIG. 1, the toilet basket shown has a holder 2 with which the toilet basket can be releasably attached by a user onto the rim of a toilet bowl.

As illustrated, the holder 2 includes a first spring element 9 and a second spring element 10. When the toilet dispenser 1 is installed in a toilet, the first spring element 9 has a substantially vertical spring travel and the second spring element 10 has a substantially horizontal spring travel, thereby enabling improved and more flexible securing of the toilet basket 1 onto toilets having different rim edge thicknesses and configurations.

Figure 2:
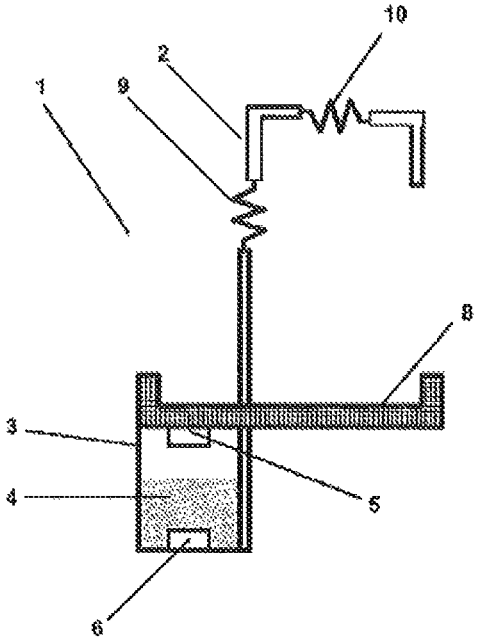
FIG. 2 is a side view of a toilet basket having a trough-like flushing water distributing element.
Figure 3:
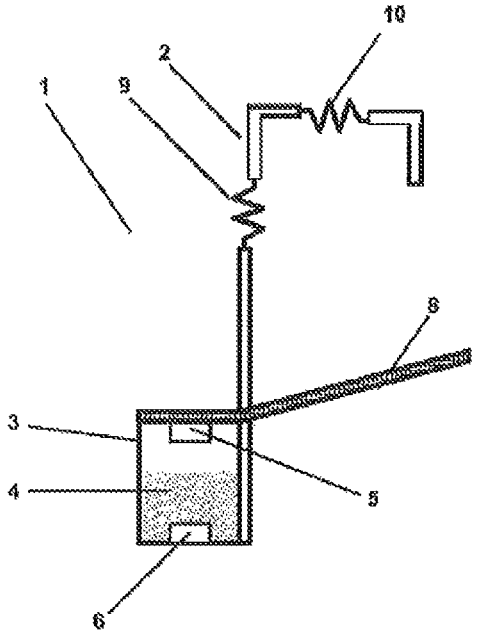
FIG. 3 is a side view of a toilet basket having a chute-like flushing water distributing element.
Figure 4:
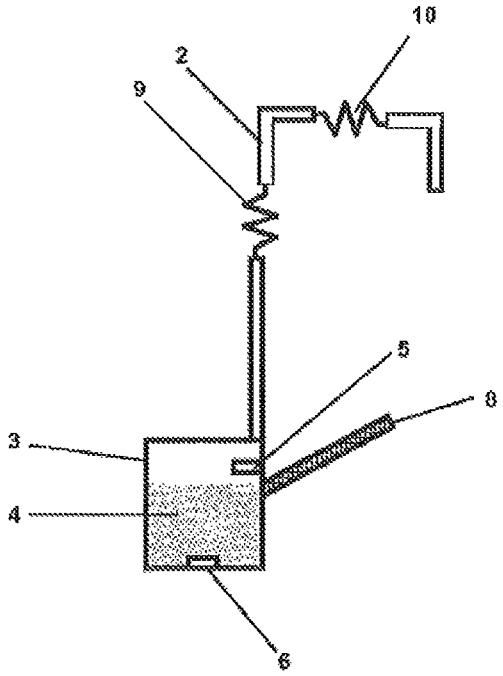
FIG. 4 is a side view of a toilet basket having a ramp-like flushing water distributing element.

Further embodiments of the flushing water distributing element 8 illustrated in FIG. 1 are seen in FIGS. 2 to 4. FIG. 2 illustrates a trough-like flushing water distributing element 8. This flushing water distributing element 8 has a peripheral rim enabling collection of flushing water in the receptacle thus formed, which is then directed through inlet openings 5 into the container 3. In addition to the baffle plate effect described above, the flushing water distributing element 8 shown in FIG. 2 can produce an equalized delivery of flushing liquid into inlet openings 5 of container 3 by temporarily storing flushing water in the trough-like flushing water distributing element 8.

Another embodiment of the flushing water distributing element 8 is illustrated in FIG. 3. This flushing water distributing element 8 is designed in a chute-like fashion. It comprises a part that is substantially horizontal when the toilet basket 1 is installed, and from which a part extends that rises oppositely to the direction of gravity. This embodiment of the flushing water distributing element 8 supplements the above-described baffle plate effect by an accelerated runoff of flushing water incident onto the flushing water distributing element 8 toward the inlet openings 5 of the container 3.

A ramp-like configuration of flushing water distributing element 8 is illustrated in FIG. 4, wherein the flushing water distributing element 8 is arranged below the inlet opening 5 of the container 3. An edge that functions similar to that of an overflow weir is thus formed between the inlet opening 5 and flushing water distributing element 8. As a result of this edge, in addition to spray water, flushing water can enter inlet opening 5 only when the water level in the funnel formed by flushing water distributing element 8 with container 3 exceeds the height of the edge or weir. Any desired combinations of the plate-, trough-, chute-, and/or ramp-like flushing water distributing elements 8 known from FIGS. 1 to 4 are also conceivable.

Figure 5:
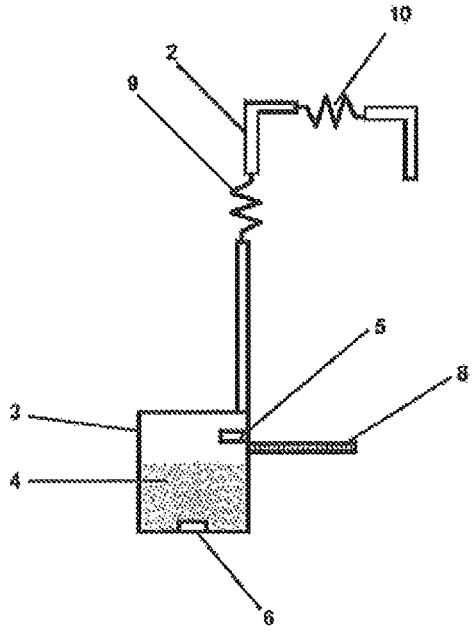
FIG. 5 is a side view of a toilet basket for solid or gelled preparations, having a flushing water distributing element arranged below the inlet opening.

An alternative embodiment of a toilet basket according to the present invention for solid or gelled preparations having a flushing water distributing element arranged below the inlet opening is shown in FIG. 5. Unlike the toilet basket illustrated in FIG. 4, the toilet basket 1 of FIG. 5 includes a plate-like flushing water distributing element 8 that, when the toilet dispenser 1 is installed in a toilet bowl, extends outwardly from below the inlet opening 5 of the container 3 toward the toilet bowl.

Figure 6:
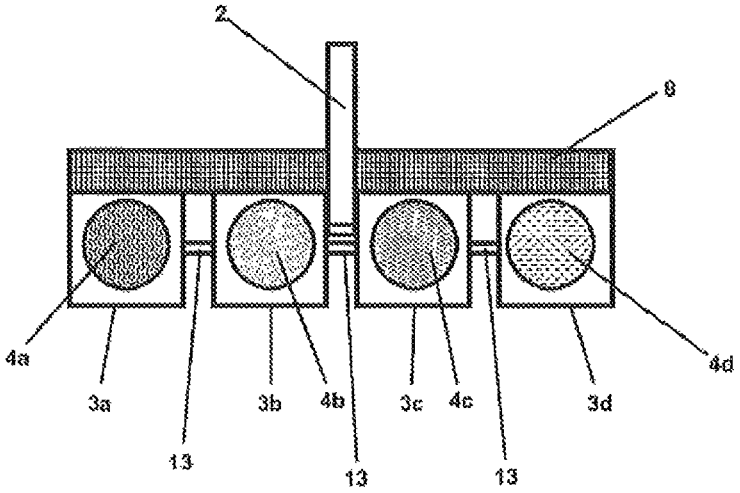
FIG. 6 is a top view of a toilet basket having containers arranged in a row next to one another, and a flushing water distributing element.

FIG. 6 provides a top view of a toilet basket 1 for solid or gelled preparations such as those illustrated in FIGS. 1 to 5. This basket 1 has four containers 3*a*, 3*b*, 3*c*, 3*d* arranged in a row and a flushing water distributing element 8. As indicated by the different cross-hatching of the preparations 4*a*, 4*b*, 4*c*, 4*d*, the containers 3*a*, 3*b*, 3*c*, 3*d* can stock different preparations 4*a*, 4*b*, 4*c*, 4*d*. The containers 3*a*, 3*b*, 3*c*, 3*d* adjacent to one another are connected to each other by a non-water-conveying connection 13.

Figure 7:
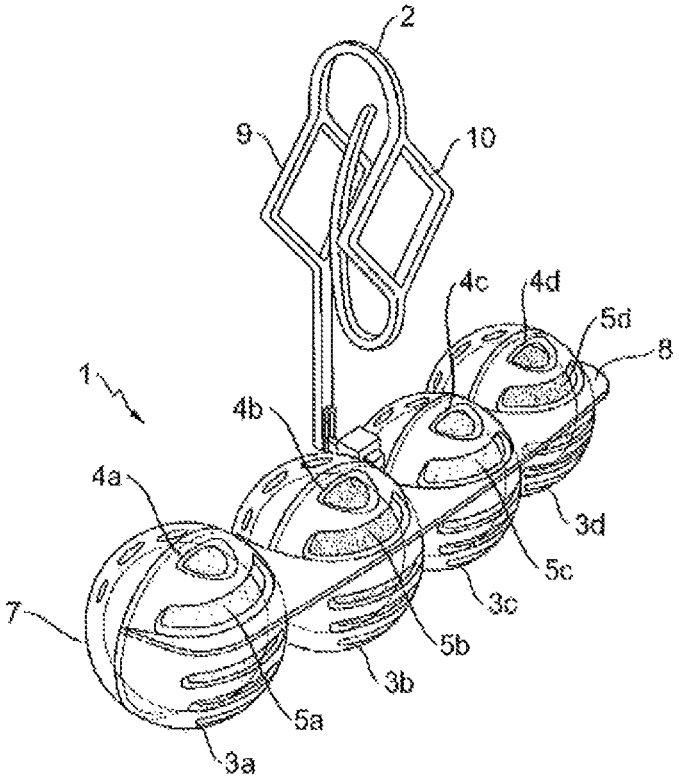
FIG. 7 is a perspective view of a toilet basket for solid or gelled preparations, having ball-like containers and a flushing water distributing element.

FIG. 7 provides a perspective view of a toilet basket 1 made of transparent material having ball-like containers 3*a*, 3*b*, 3*c*, 3*d* for solid or gelled preparations 4*a*, 4*b*, 4*c*, 4*d* and a flushing water distributing element 8. The containers 3*a*, 3*b*, 3*c*, 3*d* are arranged in a row next to one another. Stocked in the transparent containers 3*a*, 3*b*, 3*c*, 3*d* are ball-shaped, solid preparations 4*a*, 4*b*, 4*c*, 4*d*, which can differ from one another. As a result of the transparent configuration of the containers 3*a*, 3*b*, 3*c*, 3*d*, the user can easily ascertain visually the consumption status of the preparations 4*a*, 4*b*, 4*c*, 4*d*.

Figure 8:
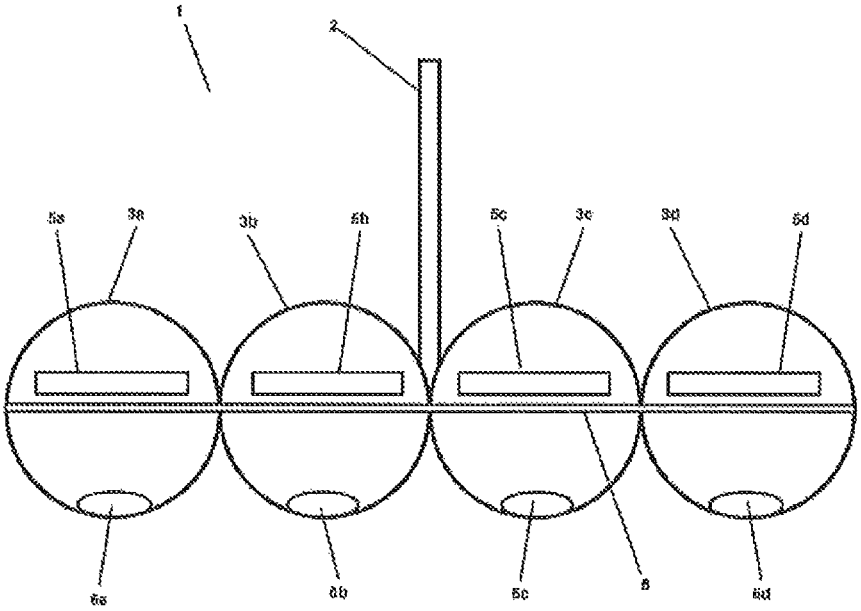
FIG. 8 is a front view of a toilet basket for solid or gelled preparations, having ball-like containers and a flushing water distributing element.

The plate-like flushing water distributing element 8, extending approximately at the height of the longitudinal axis, is arranged below the slit-shaped inlet openings 5*a*, 5*b*, 5*c*, 5*d* of containers 3*a*, 3*b*, 3*c*, 3*d*, and extends over the entire length of the toilet basket. This is also readily apparent from the front view illustrated in FIG. 8 of the toilet basket 1 from FIG. 7.

The containers 3*a*, 3*b*, 3*c*, 3*d* and distributing element 8 are integrally shaped (i.e., containers 3*a*, 3*b*, 3*c*, 3*d* are formed, for example, using an injection molding method) from two half-shell-like elements connected by a hinge-like material bridge, wherein the flushing water distributing element 8 is shaped onto one of the half-shell-like elements. Containers 3*a*, 3*b*, 3*c*, 3*d* are then formed by folding the two half-shell-like elements together, the elements being secured to one another in the assembled state by a suitable positive and/or intermaterial connection.

The one-piece holder 2 by which the toilet basket 1 is secured onto the rim of a toilet bowl has two spring elements 9, 10 embodied in a rhombic shape. When the toilet dispenser 1 is installed in the toilet, the first spring element 9 has a substantially vertical spring travel and the second spring element 10 a substantially horizontal spring travel. The spring travel made available enables an improved and more flexible securing of the toilet basket 1 onto a variety of toilets differing in rim edge thicknesses and configurations.

The manner of operation of the ball-shaped containers 3*a*, 3*b*, 3*c*, 3*d* and flushing water distributing element 8 is further explained with reference to FIG. 9.

FIG. 9 shows a first flushing water stream, schematically depicted as arrow A, incident onto the ball-shaped container, with the width of arrow A symbolizing the quantity of flushing water and the length of arrow A the flushing water velocity. When the flushing water stream strikes the ball-shaped surface of the container, the incident flushing water stream is broken up (i.e., one portion is deflected and generates a spray water component as indicated by arrow A1, and one portion is diverted over the surface of the container as symbolized by arrow A2).

FIG. 9 exemplifies a second flushing water stream B having a lower flushing water velocity and smaller flushing water quantity than flushing water stream A, as evident by its smaller arrow length and width. With a lower flushing water velocity and smaller quantity, upon striking a ball-shaped surface the spray water component is reduced and the flushing water component that is diverted onto the ball-shaped container surface after striking it is increased.

When the toilet basket 1 is installed onto a toilet, should one of the ball-shaped containers 3*a*, 3*b* be located in a segment with high-volume and strong flushing water impingement, a greater proportion of spray water is then generated, which then distributes flushing water onto the abutting ball-shaped containers 3*a*, 3*b* where it flows off over the surfaces of the ball-shaped containers 3*a*, 3*b* or travels directly into the inlet openings 5*a*, 5*b* of the containers 3*a*, 3*b*. In regions with less flushing water impingement, less spray water is generated because of the ball-like container configuration, and a larger proportion of flushing water flows off over the container surface. This produces an equalized delivery of flushing water into the inlet openings 5*a*, 5*b*.

The flushing water distributing element 8, which when the toilet basket is installed, acts as a kind of baffle plate into the flushing water stream, resulting in a similar effect. In regions of high-volume and strong flushing water impingement, a greater proportion of spray water is generated than in regions of weak flushing water impingement, so that over the area of the flushing water distributing element, an equalized delivery of flushing water into the inlet openings 5*a*, 5*b* of the container 3*a*, 3*b* occurs.

Homogeneous rinsing out of the preparations can be implemented by way of the configuration of the ball-shaped containers 3*a*, 3*b* and the flushing water distributing element 8 (in particular, by the degree to which the ball-shaped containers 3*a*, 3*b* are entirely or partly located in the flushing water stream), the size and configuration of the inlet openings 5*a*, 5*b* of the containers 3*a*, 3*b*, and the size and location of the flushing water distributing element 8.

Preferably, the ball-shaped containers 3*a*, 3*b* are designed to receive ball-shaped preparations having a diameter from 25 to 40 mm. It is further preferred that the flushing water distributing element 8 have a depth of from 2 to 20 mm, particularly preferably from 5 to 15 mm, with "depth" referring to the horizontal extension when flushing water distributing element 8 is suspended in place in the direction of the toilet bowl impinged upon by flushing water. It is further advantageous to arrange the flushing water distributing element 8 in or above the horizontal section plane containing the center point of the ball-shaped containers 3*a*, 3*b*. Spacing between the lower edges of the flushing water inlet openings 5*a*, 5*b* and the flushing water distributing element 8 is, according to a preferred embodiment of the invention, from 2 mm to 8 mm. Horizontally extending slots are further to be preferred as flushing water inlet openings 5*a*, 5*b*, with the slots preferably having a height of from 1 to 6 mm, preferably 2 to 4 mm, and a width from 5 to 35 mm, preferably 20 to 25 mm.

FIG. 10 illustrates in a top view (a) and side view (b) a toilet basket for liquid preparations and having a preparation distributing element and a flushing water distributing element.

The toilet basket 1 for receiving liquid preparations 4 includes a first container 3*a* and second container 3*b* for receiving at least one preparation 4. The containers 3*a* and 3*b* are arranged next to one another, each having an outlet opening (not illustrated) directed downwardly in the direction of gravity. Containers 3*a*, 3*b* can be coupled, individually or together, to the receptacle 12 of toilet basket 1, with the interior of the containers 3*a*, 3*b* being continuously in communication with a preparation distributing element 11 via the outlet opening, with interposition of an arrangement in receptacle 12 that prevents the preparation from flowing freely. This plate-like preparation distributing element 11 has, when the toilet basket 1 is in the installed state, an impingement region over which flushing liquid flows during the flushing operation.

For equalized delivery of flushing water onto preparation distributing element 11, there is provided above preparation distributing element 11 a flushing water distributing element 8 extending over the entire length of preparation distributing element 11. Flushing water distributing element 8 has a width that is less than the width of preparation distributing element 11, as seen in particular from FIG. 10*b*.

In this embodiment in particular, flushing water distributing element 8 can be embodied as a grid.

FIG. 11 is a cross section showing a further advantageous embodiment of a toilet basket 1 according to the present invention. As seen from FIG. 11, the preparation 4 illustrated in ball-shaped fashion rests on spacing elements 14*a*, 14*b*. These spacing elements 14*a*, 14*b* cause the outlet opening 6 of the container 3 not to be closed off by the ball-shaped preparation 4, thereby preventing clogging of the toilet dispenser.

Spacing elements 14*a*, 14*b* can assume any desired configuration, and are not limited to the exemplifying embodiment shown.

Spacing elements 14*a*, 14*b* include embodiments whereby flushing water can flow through between the spacing elements 14*a*, 14*b* to the outlet opening 6 of the container 3, as indicated by the dashed line of the spacing elements 14*a*, 14*b*.

We claim:

1. Toilet basket for receiving solid preparations comprising:

at least two containers for receiving at least one preparation, the at least two containers having at least one outlet opening, a preparation distributing element in the shape of a plate having an impingement region over which flushing liquid flows during a flushing operation, wherein an interior of the at least two container is in continuous communication with the at least one preparation distributing element via the at least one outlet opening, a holder for mounting the toilet basket onto a toilet bowl rim including at least one spring element, and a flushing water distributing element arranged and configured on the toilet basket so that the flushing water distributing element is impinged upon by flushing water upon flushing and an equalized delivery of flushing water onto the preparation distributing element is produced further comprising spacing elements in the at least two containers, the spacing elements configured to contact the at least one preparation thereby keeping the at least one preparation away from the outlet opening.

2. Toilet basket according to claim 1, wherein the flushing water distributing element is a plate, chute, ramp, or trough.

3. Toilet basket according to claim 1, wherein the flushing water distributing element is provided in shared fashion for the at least two containers.

4. Toilet basket according to claim 1, wherein the at least two containers are integrally connected to one another.

5. Toilet basket according to claim 1, wherein the at least two containers are connected to one another via a non-water-conveying strut.

6. Toilet basket according to claim 1, wherein more than one container is provided on the toilet basket, each container receiving either the same preparation or preparations differing from one another.

7. Toilet basket according to claim 1, wherein the holder comprises at least two spring elements so that when the toilet basket is installed in a toilet, one spring element has a substantially vertical spring travel and one spring element has a substantially horizontal spring travel.

8. Toilet basket according to claim 7, wherein preparations differing from one another are stored in the more than one container.

9. Toilet basket according to claim 1, wherein the flushing water distributing element (8) is integral with the at least one container.

10. Toilet basket according to claim 1, wherein the distributing element has a length corresponding substantially to a length of the toilet basket.

11. Toilet basket according to claim 1, wherein the toilet basket is elastic so that, when installed, the toilet basket can follow a contour of a toilet bowl.

* * * * *